US008220553B2

(12) United States Patent
Crawford

(10) Patent No.: US 8,220,553 B2
(45) Date of Patent: Jul. 17, 2012

(54) SUBSEA GREASE SYSTEM AND METHOD OF OPERATING SAID SYSTEM

(76) Inventor: Neil Crawford, The Woodlands, TX (US)

( * ) Notice: Subject to any disclaimer, the term of this patent is extended or adjusted under 35 U.S.C. 154(b) by 294 days.

(21) Appl. No.: 12/707,422

(22) Filed: Feb. 17, 2010

(65) Prior Publication Data

US 2011/0094731 A1 Apr. 28, 2011

Related U.S. Application Data

(60) Provisional application No. 61/255,051, filed on Oct. 26, 2009.

(51) Int. Cl.
*E21B 43/01* (2006.01)

(52) U.S. Cl. ..... 166/368; 166/241.5; 166/342

(58) Field of Classification Search ..... 166/84, 166/77, 342, 241.5, 338, 385, 339, 368, 84.2, 166/77.1, 81.1, 270.1; 175/45, 214, 202; 184/105.1

See application file for complete search history.

(56) References Cited

U.S. PATENT DOCUMENTS

| | | | | |
|---|---|---|---|---|
| 2,168,701 | A * | 8/1939 | Buttner | 222/6 |
| 4,090,573 | A | 5/1978 | Rankin | |
| 4,227,543 | A | 10/1980 | Williams, Jr. | |
| 4,386,783 | A | 6/1983 | Davis | |
| 4,428,421 | A | 1/1984 | Rankin | |
| 4,821,799 | A | 4/1989 | Wong | |
| 6,609,571 | B2 | 8/2003 | Nice et al. | |
| 2002/0104662 | A1 | 8/2002 | Dallas | |
| 2008/0264643 | A1 | 10/2008 | Skeels et al. | |
| 2009/0151956 | A1 | 6/2009 | Johansen | |

FOREIGN PATENT DOCUMENTS

| | | |
|---|---|---|
| WO | 2008-147216 | 12/2008 |

* cited by examiner

*Primary Examiner* — David Andrews
*Assistant Examiner* — Ronald Runyan
(74) *Attorney, Agent, or Firm* — Andrew W. Chu; Craft Chu PLLC

(57) ABSTRACT

The present invention is a method and system for supplying grease to maintain a sealed well during deployment of line, in particular braided electrical wire. The subsea grease cartridge system includes a subsea assembly; first and second grease containers filled with grease; a pump; a switch; and a restoring device to replenish grease containers. The method of operating the grease cartridge system includes: attaching first and second grease containers to the subsea assembly; applying hydraulic pressure to the first grease container; pumping the grease of the first grease container to a grease head; switching hydraulic pressure from the first grease container to the second grease container instantaneously when the first grease container becomes unable to supply grease properly; and pumping the grease of the second grease container to the grease head. The method includes replenishing containers from cartridges and switching back and forth between the filled grease containers.

25 Claims, 5 Drawing Sheets

SUBSEA GREASE SYSTEM AND METHOD OF OPERATING SAID SYSTEM

RELATED U.S. APPLICATIONS

The present application claims priority under U.S. Code Section 119(e) from a provisional patent application, U.S. Patent Application No. 61/255,051, filed on 26 Oct. 2009 and entitled "METHOD AND APPARATUS FOR OPERATING A SUBSEA GREASE CARTRIDGE".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to supplying line to a subsea well. More particularly, the present invention relates to operation of a subsea-mounted system to deliver pressure controlled grease at the subsea well location. Additionally, the present invention relates to a providing an efficient and constant supply of grease during line deployment.

2. Description of Related Art Including Information Disclosed Under 37 CFR 1.97 and 37 CFR 1.98

Subsea production systems are used to explore, drill and harvest oil and gas field under the ocean floor. Subsea production systems sometimes require drilling of the wells from more than one location, and water and depth factors further determine the establishment of the oil and gas field. Thus, special equipment is required to develop subsea oil and gas fields. Equipment for subsea production systems are constructed with considerations for withstanding extreme conditions, being economically cost-effective, and safe guarding the environment. Even the activity of deploying this equipment requires specialized and expensive vessels. For example, diving devices and robotic devices are used for varying water depths. Maintenance for repair and intervention on the ocean floor are usually very economically costly. The locations are remote, the equipment itself is difficult to transport and to deploy, the delivery of building and maintenance resources spans large underwater distances, and the expense of intervention can risk economic failure of an entire subsea production system.

In subsea oil and gas production, electric line is used to carry a load and supply electricity to equipment in the subsea well. The electric line must be resilient enough to extend from a surface location to the subsea well and into the well. There are two types of electric line: smooth wire and braided wire. Smooth wire is the plain linear electric line dispensed from the surface location. Braided wire is twisted or coiled, increasing flexibility and resiliency in a subsea environment. Other types of lines, such as slickline, are smooth, and there are other types of braided lines. These lines may not have electric functions, although they may have other wireline functions.

It is important to maintain a sealed and protected environment for the integrity of the electrical line and transmission of electricity, accounting for the adverse conditions of being underwater, heave compensation, length of distance traveled from the surface, and variable pressure at ocean depths. For smooth wire, the sealed environment is established by friction-fit elastomeric seals at the subsea well location. FIG. 1 shows this prior art system for smooth wire. The water cannot pass into the well as the smooth wire 10 passes through the seal 12 and into the well 14. For braided wire, the friction-fit seals are not sufficient. Because the surface of braided wire is not smooth, there is no seal against the outer diameter of the wire and the inner diameter of the annular seal. Water and fluids can pass through the annular seal and into the well.

The typical system to maintain the sealed environment for braided wire is a grease tube device, as shown in FIG. 2. A grease tube 16 dispensed from the surface has an inner diameter to be slighter larger than the braided wire 18. In this manner, the braided wire 18 can pass through the grease tube 16, across a seal 20, and into the well 22. The outer surface of the braided wire 18 is not sealed against the seal 20 because of the un-smooth surface of the braided wire 18. To maintain the seal, grease 24 is pumped from the surface and through the grease tube 16, filling the annulus formed by the braided wire 18 and the seal 20. The viscosity of the grease 24 is cooperative with the un-sealed friction-fit relationship between the braided wire 18 and the seal 20. As such, the use of grease 24 is sufficient to provide a sealing means for the well 22.

In the past, various patents have been issued in the field of delivery of grease and lubricant to a subsea well. For example, U.S. Pat. No. 6,609,571, issued on Aug. 26, 2003 to Nice, teaches a remote subsea lubricator. The lubricator is used for inserting a wireline tool into a subsea well. The lubricator has an elongated tube having an axial passage formed therethrough for receiving the wireline tool. The remote subsea lubricator is lowered beneath the surface of the sea for connection to a subsea well. Contained within the lubricator is the wireline tool. Once connected to the subsea well, the wireline tool is released from the lubricator into the well. The lubricator enables the wireline tool to enter and exit the well without sea water entering the well.

U.S. Pat. No. 4,821,799, issued on Apr. 18, 1989 to Wong teaches a system for sealing around a wireline run into or pulled from wells. The system includes a grease control head with a line wiper mounted on the well head and a grease injection control system. The grease injection control system supplies grease continuously at a constant pressure for injection into the grease control head. The control system utilizes a piston pump to supply grease to a grease chamber in a pressurizing accumulator. The accumulator has another chamber connected to a remote pressure source, which is separated from the grease chamber by a moveable partition. Constant pressure from the remote source is transmitted through the moveable partition to grease in the grease chamber maintaining a constant pressure on grease injected into the grease control head. The sealing system is provided with a conduit to return injected grease pumped through the grease head to a waste grease reservoir for disposal. This conduit includes a valve which may be closed to aid in reestablishing a blown-out grease seal.

U.S. Pat. No. 4,227,543, issued on Oct. 14, 1980 to Williams, Jr. describes a ram-type blowout preventer for use in the drilling of onshore and offshore wells. The invention has a secondary plastic injection sealing means whereby, on failure of the conventional ram seal, a well closure may still be ensured for protection of human life, equipment and the environment.

U.S. Pat. No. 4,090,573, issued on May 23, 1978, teaches an apparatus and method for use during earth boring operations when a wireline instrument is positioned within the drill string while drilling fluid is circulated, such as during directional drilling. The apparatus includes a circulating head connected to the top of the drill string that is connected to the drilling fluid pump. A wireline sealing apparatus is connected to and extends partially into the inner passage of the circulating head. The wireline sealing apparatus is of the type that has a flow tube closely fitted about the wireline and in communication with grease supplied under high pressure. The grease provides a seal while the line is stationary and while moving. Consequently, after the wireline instrument reaches the bottom of the drill string, the wireline may be pulled upward while drilling fluid is being circulated to remove slack. The wireline instrument also may be lowered and retrieved while drilling fluid is being circulated.

U.S. Pat. No. 4,386,783, issued on Jun. 7, 1983 to Davis, teaches a packing nut which when retrofitted to or assembled into a stuffing box and hydraulically or manually actuated applies force to packing in the stuffing box, compressing the packing to seal on stationary wireline or pump rods or to wipe or seal on moving wireline or rods passing through a hole in a piston rod on which there is an operating piston in the packing nut body. The piston rod may be rotated to adjust its length for packing contact, and desired packing compression may be maintained by further rod rotation if pressured fluid is not available for hydraulic actuation. A connection for a remotely pressured fluid conduit is provided on the packing nut housing to deliver actuating fluid to the operating piston.

U.S. Pat. No. 4,428,421, issued on Jan. 31, 1984 to Rankin, describes a wireline apparatus and method having features that prevent the wireline from moving with respect to the drill string due to drill string movement or wave action on the drill rig. The apparatus includes a frame having a wireline pressure sealing device. Wireline is wrapped around the drum and reeved over a sheave which is mounted to the frame near the top of the wireline sealing device. A lift sub is secured to the top of the frame and enables the frame to be lifted by the rig elevators. The frame provides a linkage between the elevators and the drill string to lift the drill string.

U.S. Patent Publication No. 2008/026643, published on Oct. 30, 2008 to Skeels et al., describes a subsea intervention system. The system is directed to a device adapted to be positioned adjacent an end of a tool housing of a subsea lubricator, wherein the device includes a structural member that is adapted to be positioned adjacent an end of the tool housing, a non-metallic body coupled to the structural member and a sealing device that is adapted to sealingly engage a wireline extending through the sealing device. The present invention is also directed to a method which includes lowering an assembly toward a tool housing of a subsea lubricator positioned subsea using a wireline for the tool to support a weight of the assembly, wherein the assembly includes a wireline tool and a device including a structural member that is adapted to be positioned adjacent the end of a tool housing, a non-metallic body coupled to the structural member, and a sealing device that is adapted to sealingly engage a wireline extending through the sealing device.

U.S. Patent Publication No. 2002/0104662, published on Aug. 8, 2002 to Dallas, teaches a seal assembly for dual string coil tubing injection into a subterranean well, including a seal plate having first and second bores with annular seals for providing a high-pressure fluid seal around first and second coil tubing strings inserted through the respective bores. The seal plate is adapted to be connected directly to a wellhead, or a lubricator if a downhole tool is connected to either one, or both of the first and second coil tubing strings. The seal assembly further includes passages for supplying lubricant to the first and second annular seals to lubricate the respective seals while the respective first and second coil tubing strings are injected into and extracted from the wellhead.

Problems remain for maintaining the seal for braided wire. In particular, the top of the prior art grease tube has an elastomeric stopper to retain the grease 24 in the grease tube 16 as grease 24 is pulled through the seal 20 by the braided wire 18 in FIG. 2. To replace this grease 24 in the grease tube 16, grease 24 is pumped through the pressurized grease tube 16. The pumped grease 24 through the grease tube 16 also provides the pressure at maintain the seal into the well 22, even as some grease 24 enters the well 22. This grease pumping presents significant obstacles for dispensing the necessary electric line. The grease must be pumped long distances from the surface to the subsea location, and the pumping action is forced through extreme environmental conditions, including temperature variations. As the temperature drops underwater, the grease becomes more viscous and difficult to pump. Powerful equipment and significant energy sources are required at the surface to complete the pumping activity. As the depth of the subsea location increases, even more power is required to move so much grease through the grease tube. The requirement for extensive pumping equipment and energy resources to accomplish the pumping show that the prior art fails to address the needs of the industry.

It is an object of the present invention to provide a grease cartridge system to maintain a sealed well during deployment of electric line.

It is an object of the present invention to provide a method for delivering grease to a sealed well during deployment of electric line at variable pressure.

It is another object of the present invention to provide a method for delivering grease without pumping from a surface location.

It is still another object of the present invention to provide a system to supply grease to a sealed well from a subsea source.

It is an object of the present invention to provide a constant supply of grease during deployment of the electric line.

It is another object of the present invention to provide a removable and replaceable grease cartridge system at a subsea well.

It is still another object of the present invention to provide a method of grease recovery from deployment of the electric line.

It is another object of the present invention to provide a cost-efficient and energy-saving system for deployment of braided wire into a sealed subsea well.

These and other objects and advantages of the present invention will become apparent from a reading of the attached specification and appended claims.

SUMMARY OF THE INVENTION

The present invention is a method and system for supplying grease to maintain a sealed well during deployment of line, in particular braided electrical wire. The method of operating the grease cartridge system includes the steps of: attaching first and second grease containers filled with grease to a subsea assembly; applying hydraulic pressure to the first grease container through an umbilical; pumping the grease of the first grease container to a grease head; switching hydraulic pressure from the first grease container to the second grease container instantaneously when the first grease container becomes unable to supply grease to the grease head at a desired rate and pressure; and pumping the grease of the second grease container to the grease head. The method further includes the step of replenishing the supply of grease in the first grease container by a grease cartridge or several cartridges at the subsea location. As the second grease container empties, the system switches back to the replenished first grease container. The restoring and switching can be repeated so that the seal is maintained as air-tight relationship with the well and the line by a constant supply of grease to the line and the well.

The grease cartridge system is positioned at a subsea location in communication with a well. This subsea grease cartridge system includes a subsea assembly; first and second grease containers being filled with grease and fixedly attached to the frame; means for pumping grease from one of the grease containers to a grease head; means for switching the pumping means instantaneously between first and second grease containers, and means for restoring grease to the first and second grease containers. The pumping means can be hydraulic pressure from an umbilical at a subsea or surface location. The switching means can be a mechanically or electronically operated switch to change the application of the hydraulic pressure when a respective grease container becomes unable to supply grease to the grease head at a desired rate and pressure. The restoring means is a plurality of subsea grease cartridges, transportable to the subsea assembly and maneuverable by subsea equipment, such as a remote operated vehicle (ROV). The cartridges can be on the subsea assembly or on a separate skid or both. The system provides grease to a seal between a line and a well, the grease maintaining an air-tight relationship with the well and the line for the entire duration of the deployment of line. In many cases, the amount of grease required is unknown, and the present invention accounts for this obstacle in a cost-effective and power-saving manner. There may also be a recovery means for excess grease and transportation means for the plurality of grease cartridges.

DETAILED DESCRIPTION OF THE DRAWINGS

Figure 1:
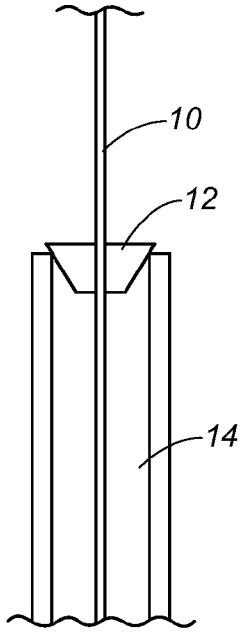
FIG. 1 Prior Art
FIG. 1 is a schematic view of the prior art system for the deployment of smooth wire as line, such as electric line or other types of wireline.
Figure 2:
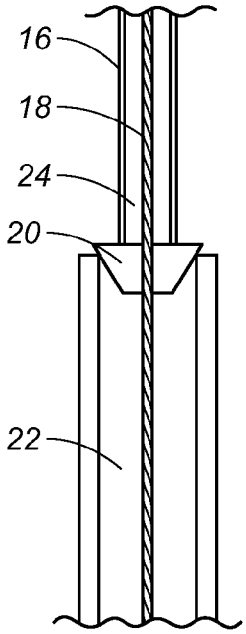
FIG. 2 Prior Art
FIG. 2 is a schematic view of the prior art system for the deployment of braided wire as line, such as electric line or other types of wireline.
Figure 3:
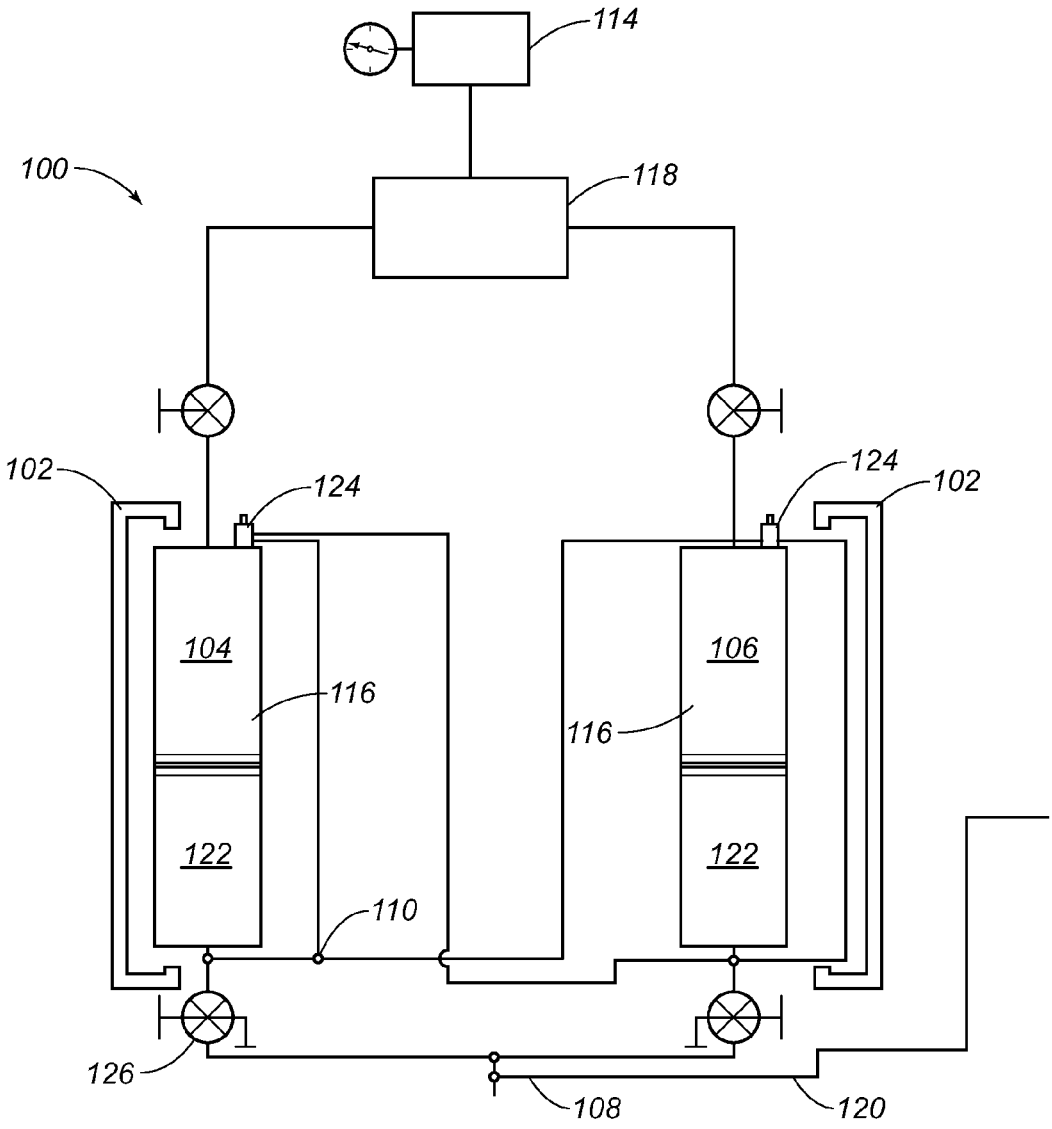
FIG. 3 is a schematic view of the system and method of the present invention, showing the operation of the grease cartridge system to maintain the seal at a subsea well during deployment of braided wire.
Figure 6:
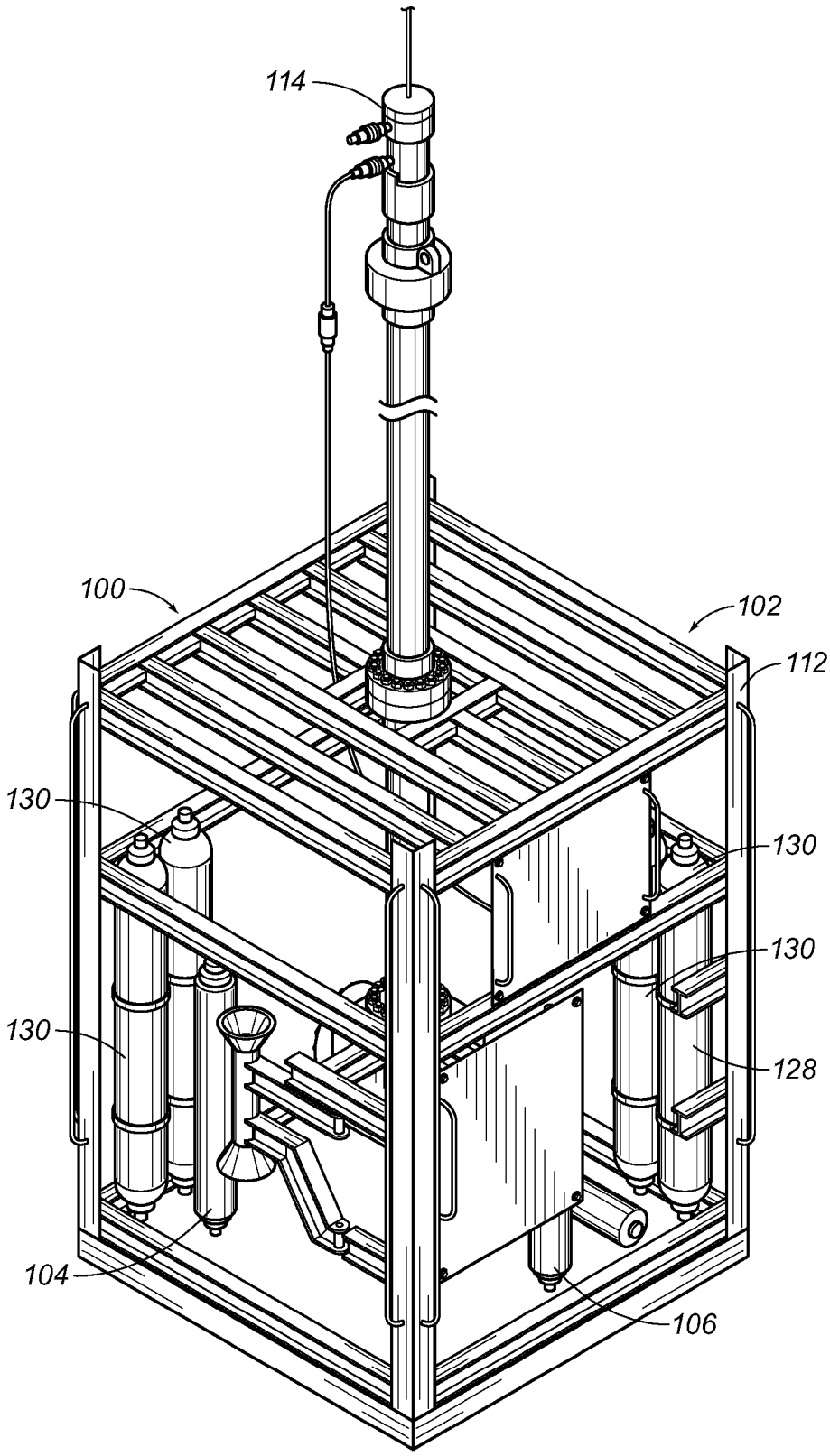
FIG. 6 shows a perspective view of the system of the present invention as configured for a subsea location.

FIG. 3 shows a preferred embodiment of the system and method of the present invention. A subsea grease cartridge system 100 comprises a subsea assembly 102, a first grease container 104, a second grease container 106, a pumping means 108, and a switch means 110. The subsea assembly 102 is a heavy-duty frame 112 suitable for deployment on the ocean floor. As shown in FIG. 6, a perspective view of the present invention, the frame 112 is capable of withstanding the varied environmental conditions during deployment and mounting in subsea locations. As indicated in FIGS. 3 and 6, the first grease container 104 and the second grease container 106 are both filled with grease 116 and fixedly attached to the frame 112. Typically, the first grease container 104 and the second grease container 106 are mounted on opposite sides of the subsea assembly 102, which improves balance of the system 100.

The pumping means 108 is shown schematically in FIG. 3. The pumping means 108 pumps grease from a single grease container, either the first grease container 104 or the second grease container 106, one at a time, to a grease head 114 on a seal between a line and a well through a connection means 118. The connection means 118 can be a hot stab set by a remote operated vehicle (ROV) to link the grease head 114 with pressure gauge. These subsea environmental elements provide context for the application of the system and are not shown in the schematic drawing of FIG. 3. The pumping means 108 maintains grease 116 to the grease head 114 for an air-tight relationship with the well and the line. The system 100 of the present invention includes a pumping means 108 comprised of a hydraulic system with an umbilical 120 extending from the subsea assembly 102. The hydraulic system applies hydraulic pressure to the first and second grease containers 104 and 106 at different times. Hydraulic fluid 122 is used to pump the grease 116 from the grease containers 104 and 106, one at a time. The hydraulic fluid 122 is more easily and efficiently pumped through an umbilical 120 than the grease 116. Importantly, the umbilical 120 of the system 100 may connect to a surface location or a subsea location such that a pump itself may be flexibly positioned at either or both locations according to the environmental conditions at the well.

The switching means 110 is also shown schematically in FIG. 3. The switch means 110 directs the pumping means 108 to the appropriate grease container 104 or 106. The pumping means 108 instantaneously switches between the first and second grease containers 104 and 106, when a respective grease container becomes unable to supply grease to the grease head 114 at a desired rate and pressure. The switching means 110 is a mechanically or electronically operated switch. The switching means can be comprised of pop valves 124 on each grease container 104 and 106. Each respective pop valve 124 actuates when a respective grease container 104 or 106 becomes unable to supply grease 116 to the grease head 114 at a desired rate and pressure. The pop valve 124 switches the pumping means 108 between the first grease container 104 and the second grease container 106. The hydraulic pressure from the umbilical 120 is applied to the remaining grease container after the switch means 110 is triggered. The switching means 110 of the present invention is instantaneous so that the flow of grease 116 is uninterrupted to the grease head 114.

The method for operating the subsea grease cartridge system 100 of the present invention includes attaching the first and second grease containers 104 and 106 to the subsea assembly 102. The subsea assembly 102 is positioned at a subsea location at a well, and connections are made between the grease head 114 and the subsea assembly 102. Next, hydraulic pressure is applied to the first grease container 104 through an umbilical 120. The umbilical 120 extending from the subsea assembly can connect to a subsea or surface location for pumping power. Grease 116 of the first grease container 104 is pumped to the grease head 114 on a seal between a line and a well, maintaining the seal in an air-tight relationship with the well and the line. When the first grease container 104 becomes unable to supply grease 116 to the grease head 114 at a desired rate and pressure, application of the hydraulic pressure is switched from the first grease container 104 to the second grease container 106 instantaneously. Constant supply of grease is maintained as grease 116 of the second grease container 106 into the grease head 114 without a gap. The step of applying hydraulic pressure further comprises connecting the umbilical 120 to a hydraulic valve means 126 on the first grease container 104 and connecting a pump to the umbilical 120. Thus, the step of pumping the grease 116 from the first grease container 104 includes pressuring hydraulic fluid 122 in the first grease container so as to dispense grease 116 at a set amount, rate, and pressure to the grease head 114 through the connection means 118. The umbilical 120 may be connected to a separate means for controlling the pumping therethrough.

In this preferred embodiment of the invention, the grease cartridge system 100 maintains a sealed well during deployment of line, such as electric line or other types of wireline. The system 100 is removable and replaceable at a subsea well, which eliminates or reduces the amount of expensive equipment, pumping requirements, and energy consumption for the delivery of grease 116 to the subsea location. The surface location is no longer required to support the pumping of grease, and the environment conditions between the surface and the subsea well have a reduced impact on the deployment of the electric line and grease travel to the grease head. Additionally, the use of two tanks increases the supply of grease available and enables a constant supply of grease. The deployment of line can be accomplished with the cheaper and faster system of the present invention.

Figure 4:
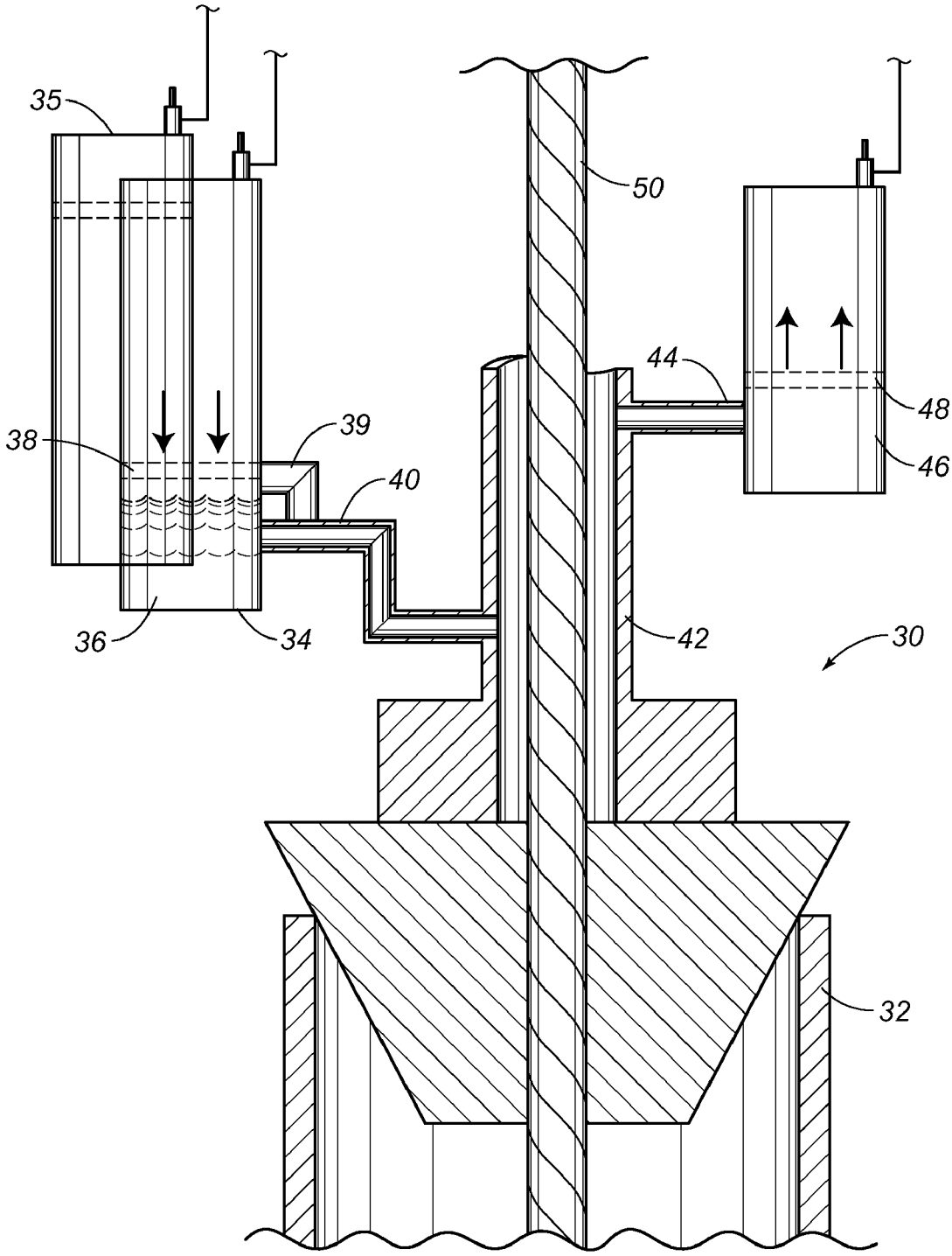
FIG. 4 is another schematic view of the system of the present invention, showing an alternative embodiment with recovery of excess grease from the grease head.

Referring to FIG. 4, the present invention includes an alternative embodiment grease cartridge system 30 for recovery of excess grease, in addition to maintaining a sealed well during deployment of line, in particular braided wire. The alternative embodiment grease cartridge system 30 is removably attached to the well 32 at the subsea location, and the grease cartridge system 30 can be manually installed at the subsea assembly by a remote operated vehicle (ROV). The grease cartridge system 30 includes a first grease container 34 filled with grease 36 with a pressure interface 38, an outlet means 40, a grease head 42, an overflow or return means 44, a grease reservoir 46 with a pressure interface 48. The first grease container 34 supplies the grease 36 to be pumped to the grease head 42 for the sealing activity at the well 32. A second grease container 35 is schematically shown, having a corresponding pressure interface and outlet means 39. The first and second grease containers 34 and 35 are similarly linked together as described in the initial embodiment of the invention of FIG. 3. FIG. 4 adds grease reservoir 46 with a hydraulic control by the pressure interface 48 as the recovery elements of the grease cartridge system of the present invention. As such, the grease reservoir 46 is comprised of a chamber pressurized by hydraulic fluid and a pressure transducer as the pressure interface 48, and this hydraulic fluid can be supplied and controlled by an umbilical from a surface location.

For the example of FIG. 4 and the first grease container 34, the grease head 42 is mounted on the subsea well 32 to apply the grease 36 to the line 50, such as electric line or other wireline. A sealed relationship is formed between the line 50 and the well 32 during deployment of the electric line 50 and when the line 50 is stationary. Excess grease 36, which is not carried into the well 32, can collect in the grease head 42. The amount of excess grease 36 builds, such that the grease 36 exits through the overflow or return means 44 to the grease reservoir 46.

The method of the present invention may further comprise recovering excess grease from the grease head in a grease reservoir. The excess grease comes from grease remaining at the grease head after the seal is formed and maintained. The grease reservoir activates to store excess grease in the chamber or to dispense excess grease from the chamber back to the grease head to maintain the seal between the line and the well.

The grease reservoir 46 can be an accumulator with hydraulic control and monitoring by an umbilical. The umbilical connects to a subsea or surface location for present control of the pressure interface or pressure transducer 48. In this manner, the grease reservoir 46 can be an extra source of grease for the constant supply during deployment of line. The monitor tracks the progress of the operation of the grease cartridge system 30 according to a central computer monitor The pressure interface 38 pumps the grease 36 through the outlet means 40 to the grease head 42. The pressure interface 38 can engage an umbilical connected to a pump at a surface location, such that the umbilical supplies the hydraulic pressure for the pumping action. As previously discussed, the hydraulic fluid pressure is more efficient than pumping grease from a surface location as in the prior art, and FIG. 4 also includes the alternative subsea pump means (not shown), wherein the pump means is attached to the subsea assembly as part of the grease cartridge system 30. The pump means at the subsea location eliminates the need for pumping from a surface location and the difficulties of transmitting such energy over long distances.

Figure 5:
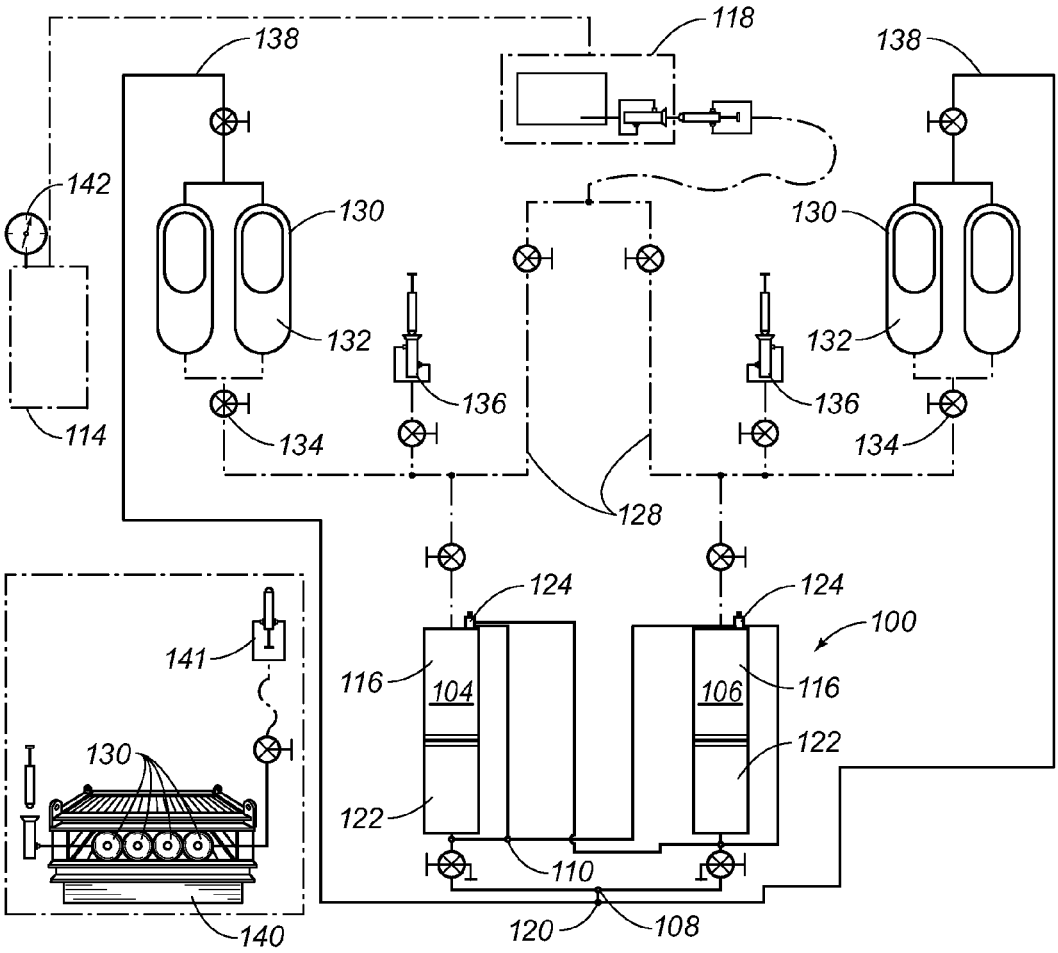
FIG. 5 is still another schematic view of the system and method of the present invention, showing re-supply of the grease cartridge system. There is a partial perspective view of a skid for the re-supply of grease cartridges.

Another innovation of the system and method of the present invention is the means for restoring grease 128, shown schematically in FIG. 5, as incorporated into the system 100. The means for restoring grease 128 replenishes the first and second grease containers 104 and 106 in order to insure a constant supply of grease to the line and the well. The means for restoring grease 128 allows the system 100 to deploy line when more grease 116 is required from the first and second grease containers 104 and 106 in the subassembly 102.

As shown in FIG. 5, the subsea grease cartridge system 100 comprises a subsea assembly 102, a first grease container 104, a second grease container 106, a pumping means 108, and a switch means 110. The means for restoring 128 is shown between the grease head 114 with connection means 118 and the first and second grease containers 104 and 106. Importantly, the means for restoring 128 interacts with the grease containers 104 and 106 on the side with grease 116 for re-filling grease 116, as opposed to the side with hydraulic fluid 122. FIG. 5 shows the means for restoring grease 128 comprising a plurality of grease cartridges 130. Each grease cartridge 130 has replacement grease 132, a grease outlet 134 and/or a connecting unit 136. The grease cartridges 130 can be mounted on the subsea frame 112 or mounted on a skid 140. The connecting unit 136 is shown in FIG. 5 as a hot stab link for control by ROV to the cartridges 130 on the skid 140. Accumulator or bladder tanks or other subsea containers can be suitable as a grease cartridge 130. FIG. 6 shows two sets of two grease cartridges 130 on the subsea assembly 102, and FIG. 5 schematically shows sets of grease cartridges 130 on a skid 140. The grease outlet 134 connects to either grease container 104 or 106, depending upon which grease container 104 or 106 requires replacement grease 132. In this manner, either grease container 104 or 106 can be restored by grease cartridges 130 on the subsea assembly 102 or by grease cartridges 130 on the skid 140. Alternatively, the grease outlet 134 can restore emptied grease cartridges 130 on the subsea assembly 102 with grease 132 from grease cartridges 130 on the skid 140. The connecting unit 136 can link the grease cartridges 130 on the skid 140 by engaging connecting unit 141, another hot stab on the skid 140.

A cartridge pumping means 138 engages the grease cartridge 130 for powering the pumping action of the replacement grease 132 into a grease container 104 or 106. FIG. 5 shows that the cartridge pumping means 138 can be the same as the pumping means 108, a hydraulic system of umbilicals 120 with either subsea or surface pump locations, depending upon environmental conditions. The means for restoring 128 further takes advantage of the easier and more efficient pumping by hydraulic fluid instead of grease through the water. The pumping means 108 can be used to control the system 100, while connections are made manually through an ROV for the connection means 118, connecting unit 136 and connecting unit 141.

When either grease container 104 or 106 becomes unable to supply grease 116 to the grease head 114 at the desired rate and pressure, the cartridge pumping means 138 replenishes the supply of grease 116 from replacement grease 132. The plurality of grease cartridges 130 can be delivered to the subsea assembly 102 by a skid 140 removably holding the plurality of grease cartridges 140. The skid can be deployed from a surface location to the subsea location with further maneuvering by a remote operated vehicle (ROV) for establishing the proper connections to the system 100 through panels or controls. The connecting unit 136 is comprised of a hydraulic interface in communication with an umbilical from a surface location so as to control pumping of the replacement grease. Typically, the connecting unit 136 can be operated by the ROV for manual control of the restoring process. The connections between the grease cartridges 130 and the grease containers 104 and 106 require real-time monitoring and actuation at this time. Similarly, the connection means 118 is now shown with the connections for hydraulic interface setting the grease 116 to the grease head 114 on the well with a pressure sensor 142. In this manner, another subsea assembly may also engage the grease head 114. Thus, the system 100 of the present invention allows for the most efficient and flexible use of grease 116, when the exact amount of deployment of line is unknown.

The method of operating the subsea grease cartridge system 100 includes restoring the grease 116 with subsea grease cartridges 130. In particular, the step of restoring includes delivering a plurality of grease cartridges 130 to the subsea assembly 12. Each grease cartridge 130 is filled with replacement grease 132 and has a grease outlet 134 and connecting unit 136. Next, a grease outlet 134 of a respective grease cartridge 130 is connected to the first grease container 104 when the first grease container 104 becomes unable to supply grease to the grease head at a desired rate and pressure. The method further includes pumping the replacement grease 132 from the grease cartridge 130 to the first grease container 104. The connecting unit 136 is a hydraulic interface in communication with the surface location and/or an ROV so as to allow control of pumping the replacement grease 132 by hydraulic pressure of a cartridge pumping means 138.

The method of the present invention includes the innovation of repeating the steps of connecting and pumping until the first grease container 104 is filled to be able to supply grease 116 to the grease head 114 at a desired rate and pressure. The amount is unknown, so at least one grease cartridge 130 may be required. While the first grease container 104 is being re-filled with grease 116, the second grease container 106 supplies grease 116 to the grease head 114. Thus, the method also includes switching the application of the hydraulic pressure from the second grease container 106 back to the first grease container 104 instantaneously when the second grease container 106 becomes unable to supply grease 116 to the grease head 114 at the desired rate and pressure and after the step of restoring grease in the first grease container 104. The re-filled first grease container 104 can be brought back into the system to continue supplying the grease head 114. The activity of the first and second grease containers 104 and 106 are coordinated so that the grease supply remains constant, even while one grease container is being re-filled any number of times.

It now follows that the step of switching is repeated from the second grease container 106 to the re-filled first grease container 104, when the second grease container 106 becomes unable to supply grease at a desired rate and pressure. Now, the second grease container 106 can be refilled by grease cartridges 130 of the means for restoring 128, while line is still being deployed with the re-filled grease 132 at the first grease container 104. Subsequently, the steps of restoring and switching repeat and alternate between the first and second grease containers 104 and 106, whenever a respective grease container becomes unable to supply grease to the grease head at a desired rate and pressure. In this alternating and repeating, a constant supply of grease 116 is supplied to the grease head 114 by the system 100 with the restoring means 128. The re-fill of the grease container is a subsea operation, which avoids pumping grease through an umbilical in the ocean and from a surface location. The alternation further sustains the system of the present invention by eliminating gaps in the grease. The switching means 110 goes back and forth, and the hydraulic pressure applied for pumping switches back and forth between the grease containers 104 and 106.

The present invention provides a grease cartridge system to maintain a sealed well during deployment of line, such as electric line or other types of wireline. The system is removable and replaceable at a subsea well, which eliminates or reduces the amount of expensive equipment, pumping requirements, and energy consumption for the delivery of grease to the subsea location. The surface location is no longer required to support the pumping of grease, and the environment conditions between the surface and the subsea well have a reduced impact on the deployment of the electric line. The deployment can be accomplished with the cheaper and faster system of the present invention. The present invention is an innovative system and method to supply grease at the subsea location, wherein the grease supply is delivered to the grease head without the expense and problems of the known prior art and existing technology. Additionally, the present invention provides flexibility in a system and method for maintaining the seal at the well at variable pressure, variable depths, adjustable rates, and adjustable amounts.

Importantly, the system provides a constant supply of grease in an inventive manner of subsea cartridges and grease containers. The grease-restoring elements allow for maintaining a constant supply of grease and efficient amounts of grease to be used. There is no excess remaining along the length of an umbilical, and the system includes a grease recovery method. The grease reservoir can be controlled to re-supply excess grease, making the system even more efficient. The innovative method of the present invention improves efficiency and lowers costs for the deployment of the electric line. There is no disruption of an extensive grease pumping operation from surface to subsea, and the system can be more immediately responsive to adjustments from the supply side and receiving side of the grease delivery operation. The present invention is a cost-efficient and energy-saving system for deployment of braided wire into a sealed subsea well.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. Method for operating a subsea grease cartridge system, the method comprising the steps of:

attaching a first grease container filled with grease and a second grease container filled with grease to a subsea assembly;

applying hydraulic pressure to said first grease container through an umbilical;

pumping said grease of said first grease container into a grease head forming a seal between a line and a well, maintaining said seal in an air-tight relationship with said well and said line;

switching application of said hydraulic pressure from said first grease container to said second grease container instantaneously when said first grease container becomes unable to supply grease to said grease head at a desired rate and pressure; and pumping said grease of said second grease container into said grease head forming said seal between said line and said well, maintaining said seal in an air-tight relationship with said well and said line in order to provide a constant supply of grease to said line and said well, wherein said step of applying hydraulic pressure further comprises:

connecting said umbilical to a hydraulic valve means on said first grease container; and connecting a pump means to said umbilical; and wherein said step of pumping said grease from said first grease container further comprises:

pressuring hydraulic fluid in said first grease container so as to dispense grease at a set amount, rate, and pressure to said grease head.

2. The method of operating a subsea grease cartridge system, according to claim 1, wherein said pump means is attached to said subsea assembly.

3. The method of operating a subsea grease cartridge system, according to claim 1, wherein said pump means is positioned on a surface location.

4. The method of operating a subsea grease cartridge system, according to claim 1, further comprising the step of:

recovering excess grease from said grease head in a grease reservoir, said excess grease being formed by grease remaining at said grease head after said seal is formed and maintained; and activating said grease reservoir to store excess grease in said chamber or to dispense excess grease from said chamber back to said grease head to maintain said seal between said line and said well.

5. The method of operating a subsea grease cartridge system, according to claim 4, wherein said grease reservoir is comprised of a chamber pressurized by hydraulic fluid, said hydraulic fluid being controlled by an umbilical from a surface location, said hydraulic fluid being monitored for pressure by a pressure transducer means.

6. The method of operating a subsea grease cartridge system, according to claim 1, further comprising the step of:

restoring grease in said first grease container with replacement grease from a grease cartridge.

7. The method of operating a subsea grease cartridge system, according to claim 6, wherein the step of restoring grease comprises:

delivering a plurality of grease cartridges to said subsea assembly, each grease cartridge being filled with replacement grease and having a grease outlet and control unit;

connecting a grease outlet of a respective grease cartridge to said first grease container when said first grease container becomes unable to supply grease to said grease head at a desired rate and pressure; and pumping said replacement grease from said grease cartridge to said first grease container.

8. The method of operating a subsea grease cartridge system, according to claim 6, wherein said step of restoring grease further comprises:

controlling pumping of said replacement grease by hydraulic pressure using a control unit with a hydraulic interface in communication with a surface location.

9. The method of operating a subsea grease cartridge system, according to claim 6, wherein said step of restoring grease further comprises:

controlling pumping of said replacement grease by hydraulic using a control unit with a hydraulic interface in communication with a remote operated vehicle.

10. The method of operating a subsea grease cartridge system, according to claim 6, wherein the step of restoring grease is performed by a remote operated vehicle.

11. The method of operating a subsea grease cartridge system, according to claim 7, further comprising:

repeating the steps of connecting and pumping until said first grease container is filled to be able to supply grease to said grease head at a desired rate and pressure.

12. The method of operating a subsea grease cartridge system, according to claim 6, further comprising:

switching application of said hydraulic pressure from said second grease container to said first grease container instantaneously when said second grease container becomes unable to supply grease to said grease head at a desired rate and pressure and after the step of restoring grease in said first grease container.

13. The method of operating a subsea grease cartridge system, according to claim 12, further comprising:

restoring grease in said second grease container with replacement grease from a grease cartridge.

14. The method of operating a subsea grease cartridge system, according to claim 13, further comprising:

repeating the steps of switching application of hydraulic pressure between the first and second grease containers and restoring grease in the first and second grease containers, whenever a respective grease container becomes unable to supply grease to said grease head at a desired rate and pressure, so as to provide a constant supply of grease to said grease head.

15. A subsea grease cartridge system comprising:

a subsea assembly, being comprised of a frame;

a first grease container being filled with grease and fixedly attached to said frame;

a second grease container being filled with grease and fixedly attached to said frame;

means for pumping grease from one of said first grease container or said second grease container to a grease head on a seal between a line and a well, the grease maintaining an air-tight relationship with said well and said line; and means for switching the pumping means instantaneously between first and second grease containers when a respective grease container becomes unable to supply grease to said grease head at a desired rate and pressure, wherein said means for pumping comprises:

a hydraulic system with an umbilical extending to said subsea assembly from a surface location, said hydraulic system applying hydraulic pressure to the first and second grease containers at different times.

16. The subsea grease cartridge system, according to claim 15, said means for pumping being comprised of a hydraulic system with an umbilical extending to a subsea pump attached to said subsea assembly, said hydraulic system applying hydraulic pressure to the first and second grease containers at different times.

17. The subsea grease cartridge system, according to claim 15, said means for switching being comprised of mechanical switches, each grease container having a respective mechanical switch, being actuated when a respective grease container becomes unable to supply grease to said grease head at a desired rate and pressure and switching the pumping means between said first grease container and said second grease container.

18. The subsea grease cartridge system, according to claim 15, said means for switching being comprised of electronic switches, each grease container having a respective electronic switch, being actuated when a respective grease container becomes unable to supply grease to said grease head at a desired rate and pressure and switching the pumping means between said first grease container and said second grease container.

19. The subsea grease cartridge system, according to claim 15, said means for switching being comprised of a pop valve, each grease container having a respective pop valve, being actuated when a respective grease container becomes unable to supply grease to said grease head at a desired rate and pressure, said pop valve switching the pumping means between said first grease container and said second grease container.

20. The subsea grease cartridge system, according to claim 15, further comprising:

a grease reservoir being comprised of a chamber pressurized by hydraulic fluid and a pressure transducer, said hydraulic fluid being controlled by an umbilical.

21. The subsea grease cartridge system, according to claim 15, further comprising:

means for restoring grease to the first and second grease containers in order to provide a constant supply of grease to said line and said well.

22. The subsea grease cartridge system, according to claim 21, wherein said means for restoring grease comprises:

a plurality of grease cartridges, each grease cartridge having replacement grease, a grease outlet and a control unit, said grease outlet being connected to either grease container, each grease cartridge having a cartridge pumping means, when either grease container becomes unable to supply grease to said grease head at a desired rate and pressure, said cartridge pumping means being at a subsea location at said subsea assembly.

23. The subsea grease cartridge system, according to claim 22, further comprising:

a skid removably holding said plurality of grease cartridges, said skid being delivered to said subsea assembly.

24. The subsea grease cartridge system, according to claim 22, wherein said control unit is comprised of a hydraulic interface in communication with an umbilical from a surface location so as to control pumping said replacement grease, said control unit being operated by a remote operated vehicle.

25. The subsea grease cartridge system, according to claim 15, wherein said first grease container and said second grease container are mounted on opposite sides of said subsea assembly.

* * * * *